United States Patent [19]

Montandon

[11] Patent Number: 4,712,500

[45] Date of Patent: Dec. 15, 1987

[54] MAST FOR SAILBOAT

[75] Inventor: Daniel Montandon, Yverdon-Les-Bains, Switzerland

[73] Assignee: Nirvana Espar Systems S.A., Yverdon-Les-Bains, Switzerland

[21] Appl. No.: 831,766

[22] Filed: Feb. 21, 1986

[30] Foreign Application Priority Data

Feb. 21, 1985 [FR] France ..... 85 02647

[51] Int. Cl.[4] ..... B63B 15/00

[52] U.S. Cl. ..... 114/90

[58] Field of Search ..... 114/90, 91, 106, 107, 114/39

[56] References Cited

U.S. PATENT DOCUMENTS 4,480,570 11/1984 Rosenfield et al. ..... 114/106

FOREIGN PATENT DOCUMENTS 2329507 1/1977 France ..... 114/90

1218455 1/1971 United Kingdom ..... 114/90

*Primary Examiner*—Sherman D. Basinger

*Attorney, Agent, or Firm*—Pollock, Vande Sande & Priddy

[57] ABSTRACT

A cross-section of the mast of this invention exhibits an external portion having roughly the form of a horseshoe, an internal portion arranged within the external portion for reinforcement thereof and having the form of an arc of a circle with the same axis of symmetry and open on the same side as the external portion, the ends of the arc being respectively coupled to the arms of the horseshoe and two closing members fixed to the respective arms and forming two lips which partially close the horseshoe opening but leave therebetween sufficient space to allow passage of a sail retained within the mast. Such arrangement is applicable to masts having an internal sail roller.

16 Claims, 1 Drawing Figure

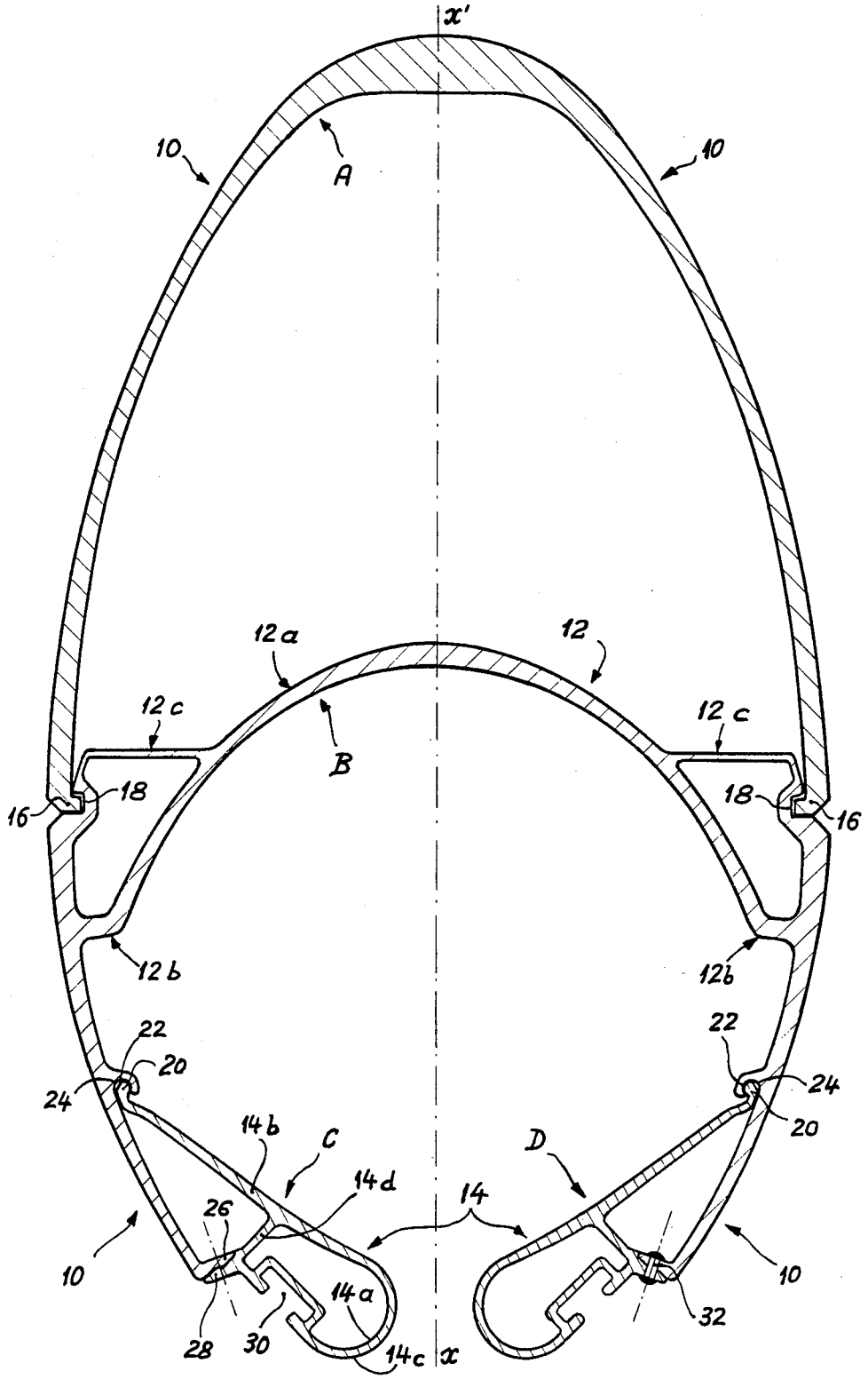
x'
10
A
10
12a
12
12c
12c
B
16
18
18
16
12b
12b
22
22
20
24
24
20
14b
C
D
14d
14
26
10
10
14a
32
28
30
14c
x

MAST FOR SAILBOAT

This invention concerns masts for sailboats, in particular it relates to a structure of a mast in the interior of which there may be placed the winding rod for a sail roller.

BACKGROUND OF THE INVENTION

At present there exists on the market a mast of this type which is formed by an extrusion drawn from a light metal or alloy having a section in the form of a horseshoe defined by two concentric walls, one of which is internal and the other external and which are coupled together by struts.

Such a structure presents certain disadvantages. Initially, its profile with two walls and struts makes manufacture thereof rather difficult. Moreover, when the sail is heavily loaded by the wind, its rigidity is not always sufficient to prevent opening of the horseshoe under the action of the winding rod of the sail roller which thus may come out of its housing. Finally, the existence of two walls does not facilitate the placing of a pulley at the head of the mast since it is then necessary to pierce through both of these walls. The present invention has for its purpose to provide a sailing boat mast which overcomes the above cited disadvantages.

SUMMARY OF THE INVENTION

The invention thus comprises a mast for sailboats having a cross-section which exhibits an external portion having roughly the form of a horseshoe; an internal portion arranged within the external portion for reinforcement thereof and having the form of an arc of a circle with the same axis of symmetry and open on the same side as the external portion, the ends of said arc being respectively coupled to the arms of the horseshoe; and two closing members fixed to the respective arms and forming two lips which partially close the horseshoe opening but leave therebetween sufficient space to allow passage of a sail retained within the mast.

In an advantageous manner, the mast may be constituted by the assembly of two extrusions, respectively forming two closing members and at least one third extrusion forming the external and internal portions.

Other characteristics of the invention as well as its advantages will come out in the description to follow having regard to the attached drawing and giving a nonlimiting explanation of an advantageous form of realization of such a mast.

BRIEF DESCRIPTION OF THE DRAWING

The single FIGURE is a cross-sectional view of a mast for a sailboat according to the invention.

DESCRIPTION OF THE PREFERRED EMBODIMENT

The mast as shown on the drawing possesses a structure the cross-section of which may be divided into four portions, namely an external portion 10 having roughly the form of a horseshoe with an axis of symmetry xx', the wall cut by this axis at the top of the drawing constituting the front of the mast;

an internal portion for reinforcement of the horseshoe 12 formed by a part essentially in the form of an arc of a circle **12*a* likewise having an axis of symmetry xx' and open in the same sense as the horseshoe and with two connecting arms 12*b*** coupling respectively the two ends of the arc of the circle to the arms of the horseshoe; and two identical closing members arranged respectively at the ends of the arms of the horseshoe, i.e. at the back of the mast and forming two lips directed towards one another and leaving between them a small gap.

In order to give a more definite but nevertheless purely indicative idea, the relationship between the dimension of the horseshoe 10 along the xx' axis (length) and its greatest dimension according to the direction perpendicular to this axis (width) is indicated to be about 1.5. The relationship between its width and the dimension of its opening is approximately 1.6. Concerning portion 12 which may be considered by way of simplification to have the form of an Ω, the circular arc **12*a*** covers an angle from 160° to 170° and the relationship between its radius and the width of the horseshoe is about 0.35 to 0.40. The distance which separates its center from the base of the horseshoe represents between 25% and 30% of its length.

It is immediately apparent that thanks to the presence of the reinforcing portion in the form of Ω, such a structure possesses an excellent rigidity. The latter may be further improved by two struts **12*c*** connecting the body of the arc of the circle to the arms of the horseshoe.

The structure thus formed in the portion thereof closest to the opening of the horseshoe provides an unencumbered volume which serves to receive the winding rod of a sail roller. The space which separates the ends of the two lips 14 is intended for the passage of the sail.

The general form of the structure having been described, there will now be undertaken a description of the manner in which it may be obtained.

In the example shown on the FIGURE, the mast is formed by the assembly of four extrusions a, b, c and d obtained by drawing from an alloy or light metal such as aluminium.

More precisely, the portion in the form of a horseshoe 10 and the portion in the form of Ω12 are constituted by two extrusions A and B of which one A forms the rounded portion of the horseshoe and a portion of its arms, while the other B forms the remainder of the arms and the totality of the portion in the form of Ω. These two extrusions are assembled by a snap or catch system in exploiting the relative elasticity of the branches of the extrusion A. The latter includes, at each end, a projecting portion 16 directed towards the interior which may be accommodated in a notch 18 arranged on the outer side of the end corresponding of extrusion B. At the time of assembly, the elasticity of the extrusion A permits that it be opened slightly in order to allow penetration between the ends of its arms, of the ends of the extrusion B to the point where the projecting parts 16 enter the notches 18.

The two other extrusions C and D are mirror identical to one another and constitute respectively the two closing members or lips 14 of the structure. These extrusions which partially block the rear portion of the mast in allowing only a slot for the passage of the sail, are hooked to the extremities of extrusion B. They exhibit a rounded wall **14*a* forming the extremity of the lip and are extended by a wall 14*b* facing towards the interior of the mast and by a wall 14*c* facing towards the exterior. Wall 14*b* has a length essentially double that of wall 14*c* and is terminated at the end of the extrusion B. Finally, a reinforcing wall 14*d* connects the end of wall 14*c* to the center of wall 14*b*. The rounded portion of wall 14***a* presents a softened profile which, when the sail contacts the lip, reduces substantially the risk of it being damaged thereby.

Coupling of extrusions C and D to the ends of extrusion B is obtained at two points. More precisely, wall 14*b* terminates by a rounded portion 20 which may be placed in a groove 22 arranged on the interior of extrusion B. A flattened portion 24 is provided at the base of this rounded portion 20 to permit introduction of the latter into the groove 22. The other connection point is placed at the end of extrusion B which comprises a projecting notch portion 26 cooperating with another projecting notch portion 28 of complementary form which prolongs wall 14*d*. Extrusions C and D are thus hooked to extrusion B by a nesting system and by a snap or catch system.

Wall 14*c* may advantageously include an opening ending up in a cavity 30 which enables the attachment of an auxiliary sail.

In order to assure the retention in place of extrusions C and D which may be subjected by forces transmitted from the sail to strong pressures from the direction of the inside of the mast, it is advantageous to reinforce their coupling by the aid of rivets 32 fastened in the notched portions 26 and 28. This may however pose a problem. In effect, the free space left between the ends of the lips is small and it is not possible when the extrusions C and D are riveted to have access to the sail roller which is entirely emprisoned within the mast. To overcome this problem, the extrusions C and D over the length of the mast, may be formed in several sections. Some of these sections are riveted, while others at zones where access to the roller must be possible, are not riveted and may thus be easily removed.

The structure hereinbefore described is substantially the same for all sizes of masts. On the other hand, the manner in which this structure may be obtained and more particularly the number of extrusions employed may differ. The example described employing two extrusions to form the portion in the form of a horseshoe and the portion in the form of an Ω, concerns a structure of which the section has a length of 44 cm and a width of 30 cm. For a mast of larger dimensions, it may be advantageous to realize the extrusion A in two, or even three parts. On the other hand, for a small mast, the extrusions A and B may be replaced by a single extrusion. It is also necessary to mention that these two extrusions may be assembled by welding, gluing or riveting.

The advantages of the invention may now be clearly seen. Initially, the structure adopted and more particularly the horseshoe with a single wall reinforced by an Ω profile, gives the mast an excellent rigidity which is furthermore substantially reinforced by the two rear lips. Thanks to this rigidity and the presence of the lips which close the cavity containing the winding rod for the roller, the latter not only is not subject to the risk of coming out of the mast, but also remains straight, which is important in order that rolling the sail may be undertaken in good conditions. This rigidity does not however prevent easy access to the important elements of the sail roller retained within the mast thanks to the means of connecting the lips and their realization in several sections. Moreover, the extrusions utilized have forms which make their manufacture very easy. Finally, the placing of pulleys at the front and the head of the mast does not pose any particular problem since only one wall need be pierced.

What I claim is:

1. A mast for sail boats having a cross-section which exhibits:

an external portion having roughly the form of a horseshoe with rearwardly extending arms defining a horseshoe opening;

an internal portion arranged within the external portion for reinforcement thereof and having the form of an arc of a circle with the same axis of symmetry and open on the same side as the external portion, the ends of said arc being respectively coupled to the arms of the horseshoe; and two rigid closing members fixed to the respective arms for reinforcement thereof and forming two lips which partially close the horseshoe opening but leave therebetween sufficient space to allow passage of a sail retained within the mast;

each of said rigid closing members providing a closed hollow wall portion of substantially triangular cross-section comprising a wall facing toward the interior of the mast, a wall facing toward the exterior of the mast, and a rounded wall forming the base of said triangular cross-section and providing a softened profile at an extremity of a corresponding one of said lips for reducing the risk of damage to a sail when it contacts said corresponding lip; and, said mast comprising a first extrusion forming one of said closing members, a second extrusion forming the other of said closing members, and a third extrusion forming at least one of said external and internal portions.

2. A mast as set forth in claim 1 wherein said external and internal portions are formed by the assembly of at least two extrusions.

3. A mast as set forth in claim 2 wherein one of said extrusions forms the internal portion and a part of the arms of the external portion.

4. A mast as set forth in claim 2 wherein the extrusions forming the external and internal portions are assembled by a catch system.

5. A mast as set forth in claim 1 in which the extrusions forming the closing members are fastened to the ends of the horseshoe arms by a nesting system and by a catch system.

6. A mast as set forth in claim 5 wherein the extrusions forming the closing members comprise a plurality of sections over the length of the mast, certain of said sections being additionally fixed to the ends of the horseshoe arms by riveting.

7. A mast as set forth in claim 1 wherein said closed hollow wall portion further comprises an internal reinforcing wall dividing said closed hollow wall portion of substantially triangular cross-section into two hollow parts.

8. A mast as set forth in claim 7 wherein said rounded wall is connected with said internal reinforcing wall by a wall of said closing member facing toward the exterior of the mast.

9. A mast as set forth in claim 8 wherein said exterior facing wall forms a cavity for attaching an auxiliary sail to the mast.

10. A mast as set forth in claim 1 in which the arc of said internal portion, a part of each of said horseshoe arms, and an interiorly facing wall of each of said closing members form a cavity for the winding rod of a sail roller.

11. A mast as set forth in claim 1 wherein said internal portion is further coupled to said external portion by a pair of struts one connecting each arm of the horseshoe to the body of said circular arc intermediate between its ends.

12. A mast as set forth in claim 1 wherein the relationship between the dimension of the external portion along said axis of symmetry and the greatest dimension of the external portion perpendicular to said axis is a ratio of about 1.5.

13. A mast as set forth in claim 1 wherein the circular arc of said internal portion covers an angle from 160° to 170°.

14. A mast as set forth in claim 1 wherein the relationship between the radius of the circular arc of said internal portion and the greatest dimension of said external portion perpendicular to said axis of symmetry is a ratio of about 0.35 to 0.40.

15. A mast as set forth in claim 1 wherein said closing members are positioned between a rear part of said horseshoe arms and said axis of symmetry.

16. A mast as set forth in claim 1 wherein each of said closing members is connected at two different locations to the corresponding horseshoe arm.

* * * * *